US007320539B2

(12) United States Patent
Christenson et al.

(10) Patent No.: US 7,320,539 B2
(45) Date of Patent: Jan. 22, 2008

(54) CONCRETE BATCHING FACILITY AND METHOD

(75) Inventors: Ronald E. Christenson, Parsons, TN (US); Robert J. Horton, Rochester, MN (US)

(73) Assignee: McNeilus Truck and Manufacturing, Inc., Dodge Center, MN (US)

( * ) Notice: Subject to any disclaimer, the term of this patent is extended or adjusted under 35 U.S.C. 154(b) by 468 days.

(21) Appl. No.: 10/818,394

(22) Filed: Apr. 5, 2004

(65) Prior Publication Data

US 2005/0219941 A1 Oct. 6, 2005

(51) Int. Cl.
*B28C 7/04* (2006.01)
*B28C 7/06* (2006.01)
*B28C 7/12* (2006.01)

(52) U.S. Cl. ..... 366/14; 366/17; 366/18; 366/20; 366/34; 366/35; 366/50; 366/66; 366/301; 366/323

(58) Field of Classification Search ..... 366/14, 366/15, 17, 18, 20, 35, 38, 50, 64, 156.1, 366/156.2, 301, 66, 323, 34
See application file for complete search history.

(56) References Cited

U.S. PATENT DOCUMENTS

| | | | | | |
|---|---|---|---|---|---|
| 2,893,602 | A | * | 7/1959 | Heacock et al. | 366/18 |
| 2,991,870 | A | * | 7/1961 | Griffith et al. | |
| 3,661,365 | A | * | 5/1972 | Cloud, Jr. | 366/18 |
| 3,967,815 | A | * | 7/1976 | Backus et al. | 366/64 |
| 3,998,436 | A | | 12/1976 | Allen et al. | |
| 4,204,773 | A | | 5/1980 | Bates | |
| 4,395,128 | A | * | 7/1983 | Mathis et al. | 366/18 |
| 4,548,507 | A | * | 10/1985 | Mathis et al. | 366/156.2 |
| 5,352,035 | A | | 10/1994 | Macaulay et al. | |
| 5,411,329 | A | | 5/1995 | Perry | |
| 5,427,448 | A | | 6/1995 | Macaulay et al. | |
| 5,527,387 | A | | 6/1996 | Andersen et al. | |
| 5,667,298 | A | * | 9/1997 | Musil et al. | 366/18 |
| 5,785,420 | A | | 7/1998 | Schuff | |
| 5,873,653 | A | * | 2/1999 | Paetzold | 366/35 |
| 6,030,112 | A | | 2/2000 | Milek | |
| 6,293,689 | B1 | | 9/2001 | Guntert, Jr. et al. | |
| 6,450,679 | B1 | | 9/2002 | Dahlinger et al. | |
| 6,638,394 | B2 | | 10/2003 | Mayer et al. | |
| 2005/0219941 | A1 | * | 10/2005 | Christenson et al. | 366/18 |

FOREIGN PATENT DOCUMENTS

| | | | |
|---|---|---|---|
| CA | 1168523 | | 6/1984 |
| CA | 2220986 | | 3/1995 |
| FR | 2392713 | * | 12/1978 |
| GB | 2098497 A | * | 11/1982 |
| GB | 2276831 A | * | 10/1994 |
| JP | 10-287459 | * | 10/1998 |
| WO | WO 01/76839 | | 10/2001 |
| WO | WO 01/85322 | | 11/2001 |

* cited by examiner

*Primary Examiner*—Charles E. Cooley
(74) *Attorney, Agent, or Firm*—Nikolai & Mersereau, PA; C. G. Mersereau

(57) ABSTRACT

A concrete batch mixing system and method are disclosed that enable the batch master to measure and control both the water and cementitious ingredient feeds in relation to each other so as to be able to blend the two ingredients in a known, selected, adjustable and repeatable manner, and to agglomerate these ingredients in a counter-rotating twin screw mixing apparatus for use in the preparation of batches of mixed concrete in a concrete batching process.

16 Claims, 6 Drawing Sheets

CONCRETE BATCHING FACILITY AND METHOD

BACKGROUND OF THE INVENTION

I. Field of the Invention

The present invention relates generally to concrete batching operations and, particularly, to advances in equipment, and in a method of processing or batching the ingredients used to produce concrete mixes. Specifically, this invention encompasses a batching operation that includes a pre-mix system which measures and controls both the water and the cementitious material feeds in relation to each other so as to be able to blend these components in a known, selected, adjustable and repeatable manner that optimizes the water/cement ratio and therefore the production and strength of the concrete mixture for each mix design. The pre-mix system further includes a twin screw agglomerator pre-mixing unit for blending or pre-mixing these materials prior to combining them with aggregates in a drum of a transit mixer truck or other final mixing vessel.

II. Related Art

In a typical concrete batching operation, all the ingredients are pre-measured and then all the ingredients are transferred to a mobile concrete mixing truck for mixing and transport to job sites remote from the sources of the concrete ingredients. In some batching operations, all the ingredients may be transferred to a pre-mixer, which is a permanent part of the batching operation, before being transferred to a mobile concrete mixing truck or other receiving vehicle.

Pre-mixing of the water and cementitious materials prior to bringing them together with the aggregates is known to offer several advantages. These advantages include, but are not limited to:

1. Increased concrete strength results from improved hydration of the cementitious materials.
2. Cost savings result from increased concrete strength when the concrete producer is supplying a strength based concrete.
3. Improved truck utilization is possible due to faster loading of agglomerated mixes into mobile concrete mixer trucks.
4. Better dust suppression is accomplished by elimination of the need to directly feed dry cementitious ingredients into mixer truck drums.
5. Generally cleaner mixer truck drums are seen, both inside and out, thereby simplifying clean out.
6. Material build-up on the back side of the truck mixer fins is reduced.
7. Both truck mixer head packs and cement balling in the load are eliminated.

In recent years, attempts have been made to design equipment that would pre-mix the water and cementitious materials as part of the batching process before combining them with the aggregates. Such devices have been only partially successful.

One such approach has employed vortex-type mixers. Vortex mixers in some ways resemble home blenders. They include a large open-face pump at the base of each unit and a drain valve at the base of the pump which is situated above a charging hopper of a transit mixing truck as a final mixing vessel. The cementitious materials, water and some of the admixtures are introduced into the top of the vortex mixer. The ingredients are blended and thereafter, the valve at the base of the pump is opened and the mixed materials are transferred to the mixer truck where they are combined with aggregates. However, these units are limited to mix designs where the water/cement ratios are relatively high: 0.38 or greater. This may be higher than allowable for mixes designed to achieve low water/cement ratios. When this occurs, additional dry cementitious material must be added, handled separately from the rest of the cementitious material that is being blended in the vortex mixer, and charged directly into a truck. This is inefficient and may result in dusting problems.

Another device that has been used is a mixing tube employing a single screw mixing auger. In the single screw mixing auger, cementitious materials can be delivered to the mixing auger by various known methods. A water injection manifold is used to introduce the liquid materials into the cementitious materials as they are being conveyed through and by the screw auger. This type of pre-mixing device has had limited success due to an inability to overcome a variety of shortcomings which include:

1. Known units of this type have been unable to measure and control both the water and the cementitious material feeds in relation to each other so as to be able to blend these two in a known, selected, adjustable and repeatable manner.
2. The centrifugal action associated with the use of a single auger throws the materials being mixed outward and thereby forces the materials against and into water spray nozzles used to supply or infuse water into the mix causing them to plug and malfunction.
3. In addition, the action of the centrifugal force throwing the materials to the outside of the mixing tube results in incomplete mixing of the ingredients, as evidenced by the presence of streaks of dry cementitious material in the mix as it is discharged from the mixer.
4. Many single screw units experience a build-up of the mixed materials at the inlet where the cementitious materials and water begin to commingle due to insufficient baffling in this area.
5. Many single screw units also have difficulty mixing when the water/cement ratios are below 0.38.

As is the case of the vortex-type mixers, some facilities using these units must also make provisions to handle additional dry cementitious material separately from the pre-mixed cementitious material and supply it directly into a truck or other final mixer vessel.

Thus, there remains a definite need in the concrete batching field to provide a concrete batching facility that includes a pre-mix arrangement that provides an accurate system to measure and control both the water and other wetting agents and the cementitious material feeds in relation to each other so as to blend the ingredients in a known, predetermined and repeatable manner over a relative wide range of ratios of water (wetting agent) to dry ingredients.

SUMMARY OF THE INVENTION

By means of the present invention, there is provided a concrete batching system pre-mix arrangement that includes a controlled ingredient supply aspect to measure and control both wetting agent and cementitious ingredient feeds in relation to each other so as to achieve a blending of these ingredients in a known, predetermined, adjustable and repeatable manner that produces the desired water/cement ratio and therefore optimizes the production and strength of the concrete produced from the mixture for each mix design.

The term "cementitious" as used herein is defined to include Portland cement, fly ash and any other dry components, not including aggregate materials (sand and stone).

The term "wetting agents" as used herein is defined to include water with or without other additive ingredients.

Central to the ingredient supply and pre-mixing systems of the concrete batching system of the invention is an enclosed twin screw pre-mixer agglomerator chamber which is fed the cementitious materials by a cement weigh batcher using a metering screw conveyor device and is fed one or more wetting or agglomerating agents via a liquid metering system which controls both rate and total amount of wetting agent for a batch. The metering system supplies a manifold which is provided with a plurality of spaced spray nozzles situated to infuse the liquid along a portion of the agglomerator mixing chamber. The pre-mixer agglomerator is designed to be charged with dry, cementitious ingredients at an inlet end and to discharge the agglomerated or blended materials at a discharge port during normal operation.

Mixing and material conveying in the pre-mixer agglomerator vessel is accomplished by a pair intermeshing, preferably counter-rotating, screw conveyors or augers mounted for rotation in the chamber. The augers are of varying pitch in which threads or flights of relatively fine pitch, which together act as baffles, at an input end control the feed rate to a central mixing section and also prevent material build up in that area. Coarser pitch threads provide a very aggressive and efficient kneading/squeezing mixing action and strongly convey the material through a central mixing section to specially designed discharge scoops or paddles that propel mixed material out through the discharge port or outlet at the bottom of a discharge end which is opposite to the inlet end. For the purposes of this specification, pitch is defined to mean the distance between successive convolutions of the thread of a screw conveyor or auger relative to the diameter of the screw conveyor or auger. The terms "screw conveyor" and "auger" are used interchangeably herein.

The supply system and the construction of the pre-mixer agglomerator vessel and the mixing screw conveyors or augers allows any water/cement ratio to be selected and apportioned and mixed in the pre-mixer agglomerator. The pre-mixer agglomerator chamber is provided with a discharge chute designed to discharge mixed material into a collecting hopper which, in turn, leads into the input or charging hopper of a mobile concrete mixing truck or other receiving final mixing vessel located beneath the collecting hopper.

The batching system is designed so that the aggregate material (generally sand and stone) is measured and provided separately and fed directly through the collecting hopper to the input hopper of the mobile mixing truck or other final mixing device and is not mixed in the agglomerator.

In a preferred embodiment, counter-rotating full auger flights are used in the twin screw compulsory mixer of the agglomerator-mixer and, as previously indicated, they are divided into three distinct sections. The first is an inlet or receiving section that includes a short section of twin shaft counter rotating screw segments of relatively narrow or reduced pitch (such as one-quarter pitch or one-third pitch) which results in relatively small inter-flight or successive convolution gaps to regulate the delivery of cementitious materials from the discharge of a metering screw pre-feeder to the receiving or input section of the pre-mixer agglomerator and eliminate build-up in this area.

This is followed by an agglomerating or mixing section which consists of an extended length in which the twin shaft counter rotating agglomerating segments have a pitch greater than that of the inlet section (such as one-half or two-thirds pitch). This insures that the material fed from the inlet section does not completely fill the cavity of the agglomerating section thereby promoting improved mixing. Metered wetting agents are introduced into this section from a pattern of spaced nozzles located in the top of the chamber. The third and final section is a discharge section that consists of a short section of counter-rotating paddles or flat-pitch scoops that serve to eject the blended materials out of the agglomerator.

The screw pre-feeder accurately regulates the feed rate of cementitious material to the agglomerator. It is preferably a variable speed feeder which also uses reduced pitch segments (such as one-half or one-third pitch) in conjunction with multiple (double or triple) segments to create a labyrinth that eliminates the tendency of the finely divided fluidized cementitious materials to flow around and through the feeder. If desired, the system may include a by-pass line to enable the direct feed of dry powdered cementitious material through the metering screw and the agglomerator section directly into the collecting hopper to the inlet hopper of a mobile mixing truck or other final mixing vessel.

While the preferred arrangement incorporates overlapping counter-rotating twin screws that produce more vigorous kneading/squeezing mixing, a further arrangement in which both overlapping screws rotate in the same direction is also contemplated and can be used if desired.

BRIEF DESCRIPTION OF THE DRAWINGS

In the drawings wherein like numerals are utilized to depict like parts throughout the same.

DETAILED DESCRIPTION

There follows a detailed description of certain embodiments which are presented as examples which capture the essence of the invention but these representations are in no way intended to be limiting with respect to the scope of the invention as it is contemplated that other embodiments using the concept will occur to those skilled in the art. For example, the concept may be used to treat other dry ingredients in other processes having flow and mixing characteristics commensurate with or similar to dry cementitious materials and wetting agents.

Figures 1A, 1B:
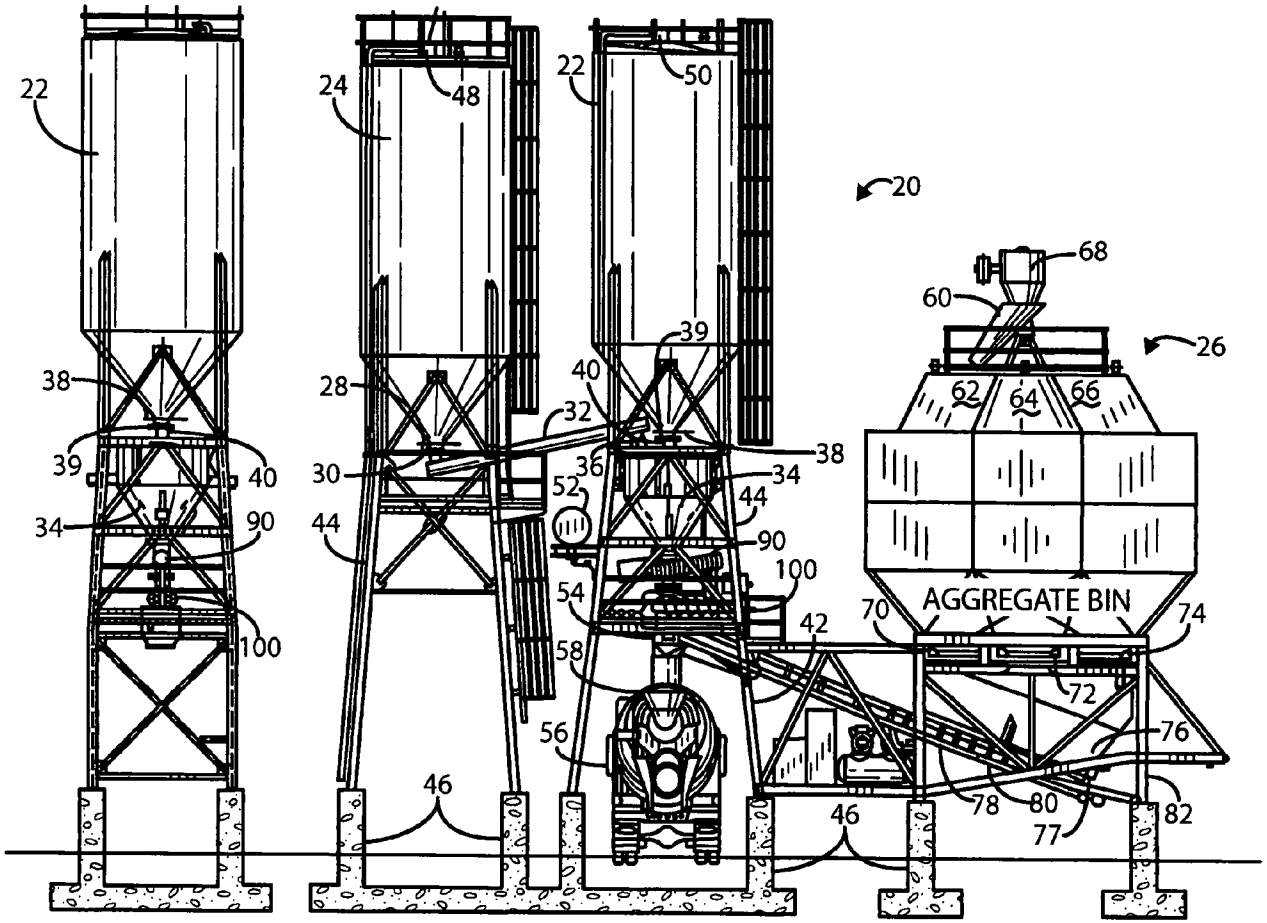
FIG. 1*a* is a schematic elevational view depicting a typical concrete batching facility utilizing the mixing system of the invention.
FIG. 1*b* is a side view of the main cement silo and mixing facility of FIG. 1*a* with parts removed for clarity.

FIGS. 1*a* and 1*b* are elevational views of a portion of a concrete batching facility, generally represented by 20, incorporating an agglomerator-mixer system in accordance with the present invention. The batching facility includes a primary Portland cement silo 22, a second silo 24 which may also contain Portland cement or other finely divided dry cementitious ingredients such as fly ash, which are typically also included in concrete mixes. An aggregate bin as shown at 26 which may have compartments containing sand and coarse stone.

Figure 2A:
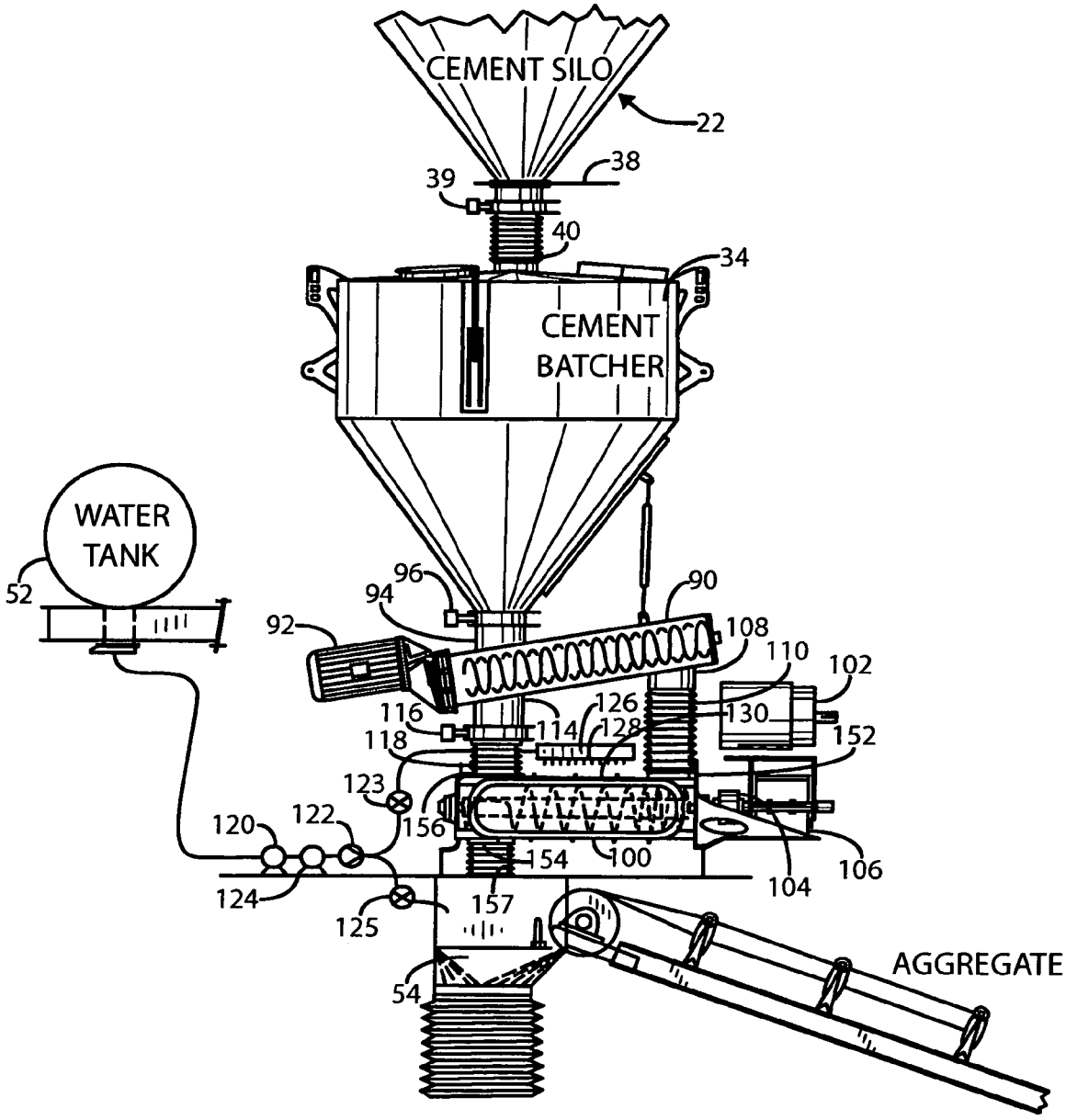
FIG. 2*a* is an enlarged fragmentary schematic elevational view of a portion of the batching facility of FIGS. 1*a* and 1*b* including the ingredient supply and pre-mixing systems of the invention.
Figure 2B:
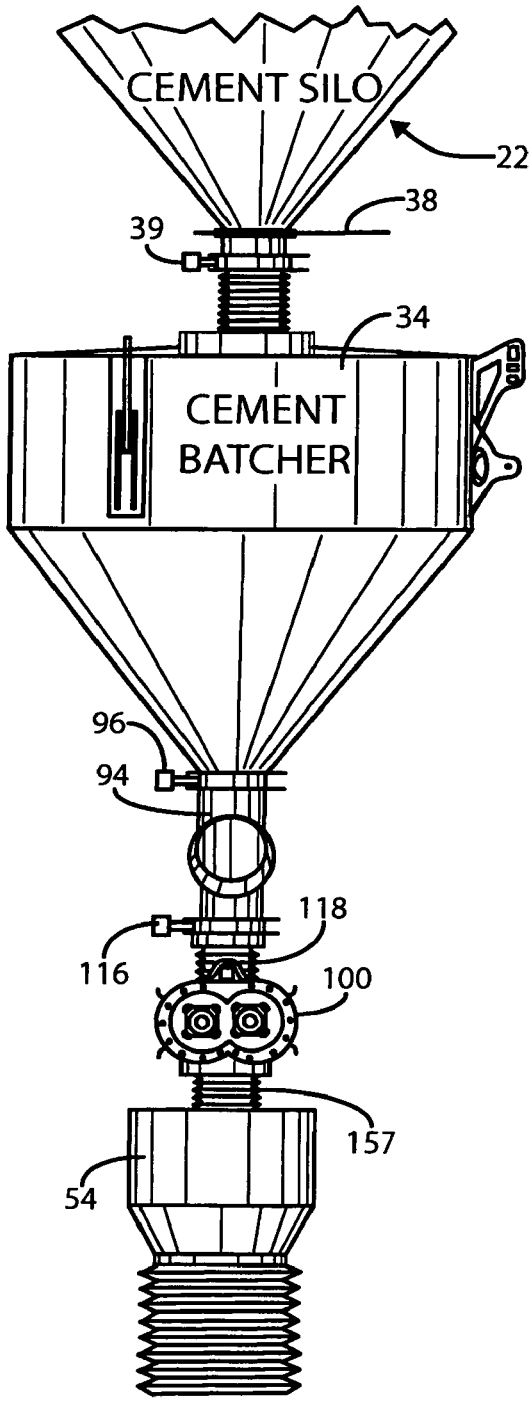
FIG. 2*b* is a partial side view of components in FIG. 2.

Silo 24 is provided with a bottom discharge gate system 28 that is connected through gate valve 30 to a covered conveyor 32 which, in turn, discharges into a covered cement weigh batcher at 34 through a chute 36. In a similar manner (and as best seen in FIGS. 2*a* and 2*b*), silo 22 is provided with a discharge valve system 38, 39 and chute 40 which also discharge into weigh batcher 34. Suitable dust filtering equipment is provided for both silos to minimize losses during charging and discharging operations. One such filter venting system is illustrated and described in U.S. Pat. No. 6,638,394, which is incorporated herein by reference to any extent necessary. Such devices are known and have been used in accordance with the charging and discharging dusting materials from storage silos; and this aspect, while important to dust reduction in batch plants, does not form a part of the present invention. Filter venting housings are shown at 48 and 50 in FIGS. 1*a* and 1*b*.

The silos 22 and 24 are elevated and suitably supported on heavy steel support structures 42 and 44. A surge tank 52 is used to supply water to be mixed with the dry ingredients from the silos 22 and 24, as will be described. A collecting hopper system is shown at 54 which receives aggregates and pre-mixed cementitious material to load into a mobile mixing truck 56 via a charging hopper 58.

The aggregate bin 26 is further divided into sections addressed by mechanized swiveling loading chute 60 as at 62, 64 and 66. Chute 60 is fed normally by conveyor (not shown) which discharges material through a receiving vessel 68 and can be rotated to address any of the sections which may optionally contain sand or different sizes of coarse stone or other aggregates. The bin sections 62, 64 and 66 are provided with discharge gates 70, 72 and 74, to discharge the aggregates into a weigh hopper 76 to be discharged through gate 77 on to a loading belt conveyor 78 equipped with belt rollers 80. Belt conveyor 78 carries and discharges material into the collecting hopper 54 for direct loading into vehicle 56 where final concrete mixing occurs. The aggregate bin is also supported in an elevated disposition by a heavy structural steel support framework 82 which may be fixed to the adjacent support structure 42 to add stability to the system. A facility such as schematically shown in FIGS. 1*a* and 1*b* may be a permanent facility or one susceptible of being transported to different locations after being collapsed into a plurality of transportable components.

FIGS. 2*a* and 2*b* represent enlarged fragmentary schematic views of a portion of the batching facility of FIGS. 1*a* and 1*b* including the ingredient supply and pre-mixer agglomerator systems of the invention. The system weigh batcher 34 is connected to the input of an enclosed variable speed metering screw or auger feed system or pre-feeder 90 driven by a computer-controlled variable speed motor 92. Known amounts of material are fed from the cement weigh batcher 34 via connecting tube 94, suitably valved by gate valve 96. The metering screw conveyor or pre-feeder 90 regulates the feed rate of dry cementitious ingredients supplied to a twin screw pre-mixer agglomerator 100 driven by a motor 102 suitably coupled in a conventional manner to a gear speed reducer system 106, as by a belt drive (not shown). Speed reducer 106 is designed to drive a pair of high torque enmeshing screws (known as a twin screw or twin auger system) in a counter rotating fashion at a designated constant speed. The speed reducer 106 is suitably coupled to the twin screws of the pre-mixer agglomerator 100 by a pair of output coupling devices, one of which is shown at 104. The twin screws are most efficient if designed to operate in a counter-rotating fashion (but may be designed to rotate in the same direction.

Pre-feeder 90 further includes a first or normal metered feed or discharge outlet as shown at 108 which may contain an outlet shutoff valve (not shown) and which is connected by flexible conduit or chute 110 to a first inlet 152 in the pre-mixer agglomerator 100 utilized for charging dry ingredients from the metering screw of pre-feeder 90 into the pre-mixer agglomerator 100 to be mixed. This is further known as the inlet or feed end of the pre-mixer agglomerator. A further discharge arrangement 114 is provided in the metering screw 90 positioned directly below the inlet from the cement batcher suitably valved at 116 and which is connected by a flexible conduit 118 with a second or by-pass inlet 156 which is located in the pre-mixer agglomerator 100 at a point directly above discharge port 154 of the pre-mixer agglomerator with chute 157 for mixed ingredients or direct feed so that dry ingredients from the cement batcher 34 alternatively on occasion can be fed directly into the hopper 54 by-passing the metering screw system 90 and the pre-mixer agglomerator 100. More detailed aspects of the twin shaft counter-rotating agglomerating screw conveyor embodiments are discussed below.

Figure 3A:
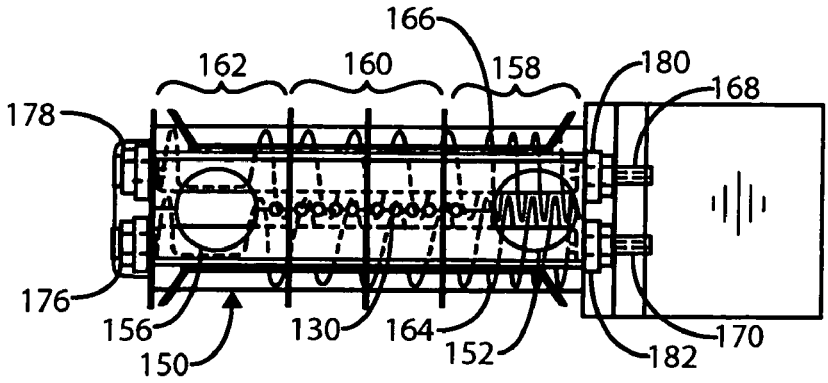
FIG. 3*a* is a schematic top view of one embodiment of a twin-screw agglomerator-mixer in accordance with the invention.
Figure 3B:
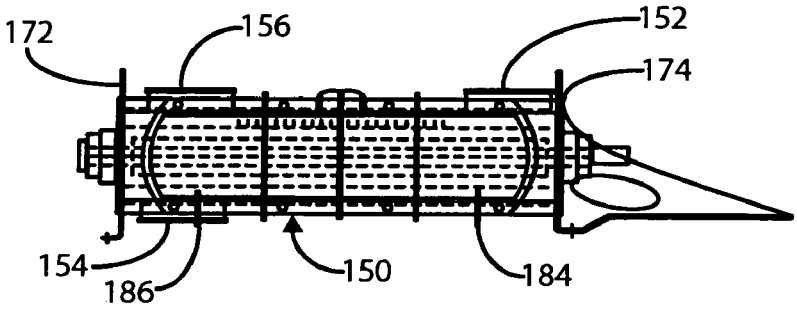
FIG. 3*b* is a schematic side elevational view of the agglomerator-mixer of FIG. 3*a;*
Figure 3C:
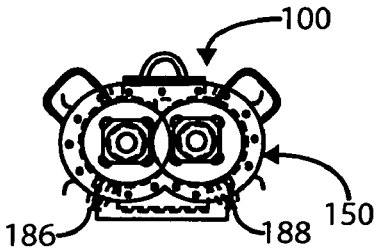
FIG. 3*c* is a schematic end view of the agglomerator-mixer of FIGS. 3*a* and 3*b;*

FIGS. 3*a*-3*c* depict one embodiment or form of an pre-mixer agglomerator 100 in accordance with the invention which includes a housing, generally at 150, a first top inlet opening 152 located toward one end of the top of the pre-mixer agglomerator 100 and a discharge opening 154 located on the bottom toward the opposite end of the pre-mixer agglomerator from the inlet opening 152 such that intended mixing takes place therebetween. The by-pass discharge arrangement 114 is aligned with the by-pass inlet opening 156 to allow straight through feed of dry ingredients as discussed above.

As will also be discussed with regard to the several example embodiments of twin-screw or twin-auger conveyors, the pre-mixer agglomerator 100 is designed to pre-mix and blend the cementitious ingredients and the liquid ingredients in a known, selected, adjustable and repeatable wetting agent/cement ratio that optimizes the desired production and strength of the concrete of the mixture for each mix design. The pre-mixer agglomerator 100 is characterized functionally by three sections, namely, an inlet metering section 158, a mixing section 160 and a discharge section 162. Water or wetting agent infusion nozzle locations are shown at 130 in FIG. 3*a*. They may be conventional spray nozzles (not shown) and are preferably limited to the mixing section, as will be discussed.

A pair of generally parallel intermeshing twin screw conveyors 164 and 166 having corresponding steel shafts 168 and 170 are mounted for rotation within the housings 172 and 174 using suitable corresponding bearings 176, 178, 180 and 182. Shafts 168 and 170 are coupled to a suitable drive mechanism with intermeshing gears (not shown) so that the intermeshing screw conveyors 164 and 166 coordinate to counter-rotate at the same speed.

The water or wetting agent supply system includes four basic components. These include surge tank 52 which preferably is designed to hold enough water to produce a minimum of 1½ batches of concrete or about 300 gallons (1272 liters). A means of refilling the surge tank (not shown) is provided with sufficient capacity to refill the surge tank 52 by the time the next batch is to be started. The system further includes a pump 120 of sufficient capacity to deliver liquid wetting agent (normally water with or without additives) to the agglomerator 100. A liquid wetting agent flow control valve 122 is provided and is one that is programmable with linear flow characteristics together with a computerized control system (FIG. 6) so that the flow can be controlled as necessary to obtain the correct feed rate to the agglomerator so as to be coordinated with the flow rate of dry ingredients over a range of flow rates. Valves 123 and 125 are also provided in the wetting agent supply system of the agglomerating mixer 100. Valve 123 is in the line to the spray nozzle system of the pre-mixer agglomerator 100 and valve 125 is a by-pass valve to allow direct infusion of wetting agents into chute 54 by-passing the pre-mixer agglomerator 100.

A water meter 124, which is provided with both digital and analog outputs, is also provided to measure the wetting agent supplied in two ways. The first output from the water meter is a discrete digital output which preferably produces one electronic impulse per gallon of liquid wetting agent being delivered to the agglomerator. These impulses are counted by a controlling computer or CPU (500 in FIG. 6). When the total amount of water required for the batch in process is reached, the flow control valves 122, 123 and 125 are closed by the computer ending supply for that batch. The second output is a continuous analog output which is proportional to the rate at which the liquid wetting agent is flowing through the meter 124. The computer uses this output to control the setting of the water flow control valve 122 in such a manner as to deliver the liquid wetting agent to the pre-mixer agglomerator 100 at the specified ratio to the cementitious materials that are being delivered at the same time to the agglomerator by the screw feeder.

Thus, the desired water feed rate can be set in a controlling computer or CPU 500 in proportion to the feed rate that has been set for dry cementitious ingredients being delivered to the agglomerator by the pre-feeder 90. The computer 500 then uses feedback from the analog output of the water meter to set the position of the water control valve to maintain the water flow called for by the computer in the specified ratio to the cementitious ingredients being delivered to the pre-mixer agglomerator. As indicated above, when the total amount of water necessary to complete the batch has been delivered, the central processor 500 will cause the valve 122 and also valves 123 and 125 to close. The meter 124 is connected to a manifold 126 which is located on the pre-mixer agglomerator 100 and contains an array of spray nozzles or jets as at 130 for adding desired amounts of water to the pre-mixer agglomerator for mixing with the dry cementitious ingredients.

Figure 4:
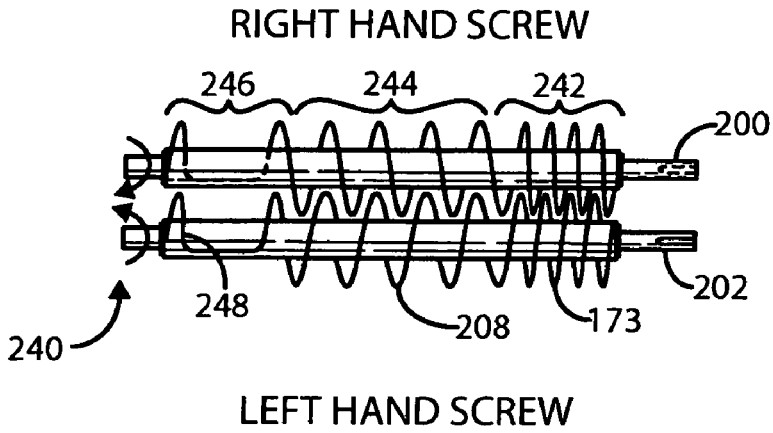
FIG. 4 is an enlarged representation of one embodiment of a pair of assembled counter-rotating intermeshed mixing screws suitable for use in the agglomerator-mixer of the embodiment of FIGS. 3*a*-3*c;*

The intermeshing, counter-rotating mixing screw conveyors of FIG. 4 may be designated 240, and including screw conveyors 200 and 202, are divided into three basic sections, these include an inlet section 242 characterized by a fine pitch section of the intermeshing screw conveyors in which the distance between intermeshing flights 173 is at a minimum. This is followed by a mixing section 244. This provides a coarse interpitch section which accomplishes an aggressive kneading/squeezing mixing with the flights 208 intermeshing. This is followed by an outlet/discharge section 246 which employs paddles 248.

With respect to the counter-rotating twin screw conveyors themselves, of course, it is apparent that they can be constructed to enmesh as either top converging or bottom converging combinations. In this regard, the preferred arrangement for optimum mixing in the pre-mixer agglomerator of the present invention involves configuring the twin screw conveyors as an arrangement where the flights rotate to converge together at the top so that material is slung down and away from the water inlet openings and, at the discharge end, toward the outlet. It should be noted, however, that the mixing efficiency itself is essentially equivalent either using a top or bottom converging arrangement. The advantage of the top converging arrangement, as stated, includes both prevention of buildup around the water inlet jets 130 and improved discharge of mixed materials.

In addition, as seen in FIGS. 3*b*-3*c*, the sides of the pre-mixer agglomerator housing can be bottom hinged as at 184 and 186 (FIG. 3*b*) and 188 (FIG. 3*c*) for easy access to the screw conveyors for cleaning.

Figure 5:
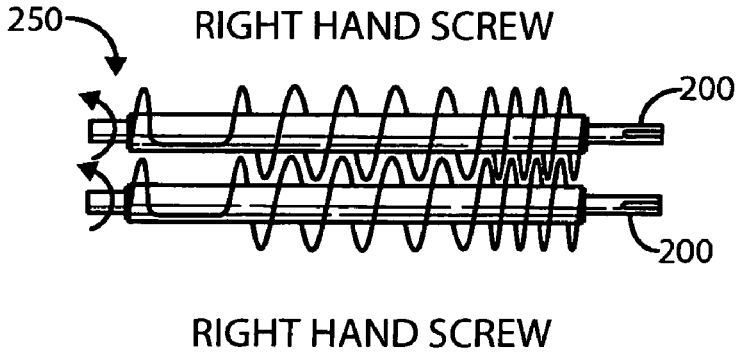
FIG. 5 is a representation similar to FIG. 4 featuring a pair of intermeshing mixing screws designed to rotate in the same direction.

FIG. 5 is a top view of an intermeshed mixer system 250 twin parallel screw conveyors similar to that of FIG. 4 but disclosing an arrangement in which both of the screw conveyors 200 rotate in the same direction. Illustrated at right hand, this arrangement utilizes two identically pitched screw conveyors, (i.e., both left hand or right hand).

The arrangements in FIGS. 4 and 5 will both accomplish mixing, however, the mixing that takes place in configuration 4 will be more efficient because in counter-rotating embodiments the ingredients are forced to be combined in a kneading or squeezing action in passing between the parallel intermeshing screw conveyors whereas in the case where the shafts rotate in the same direction, the material is passed between the parallel screw conveyors in opposite directions and is not forced together through the intermeshing flights.

Pre-mixer agglomerators in accordance with the invention, generally, are designed to operate at constant speed (although that speed can be varied if desired). The twin shaft rotating screw conveyors are specially designed for blending cementitious or other finely divided dry materials (usually Portland cement and fly ash) with liquid materials (usually water and various chemical additives) to form a pre-mixed material with a water/cement ratio that is generally designed to optimize the production and the strength of concrete produced from the mixture. The pre-mix is later combined with coarse aggregates (usually stone and sand) in the production of Portland cement concrete.

According to an aspect of the invention, as indicated in the description of representative types of twin-screw mixers, the agglomerator has been characterized as being generally divided into three distinct sections. These include an inlet section which consists of a short section of twin shaft counter rotating screw feeder segments of relatively fine or reduced pitch (such as from about one-half pitch to about one-fourth pitch) to regulate the delivery of cementitious materials from the discharge of the pre-feeder to the mixing section of the agglomerator. The mixing or agglomerating section consists of an extended section of twin shaft counter rotating agglomerating segments with a pitch greater than that of the inlet section (such as from about one-half pitch to about two-thirds pitch).

The pitch of the mixing section is made greater than that of the inlet section to ensure that the material conveyed from the inlet section does not completely fill the cavity of the mixing section. This ensures that there is sufficient empty space in the flights of the mixing or blending section to promote aggressive kneading/squeezing mixing of the cementitious ingredients and the liquids into a pre-programmed blend ratio of fully mixed material. The discharge section includes a short section of twin shaft, preferably counter-rotating scoops or paddles to help eject the blended materials out of the vessel.

Wetting agents are preferably not applied in the inlet or outlet sections to avoid undesirable buildup of materials at the inlet end of the conveyors. Clogging and material buildup has long been a problem with single screw systems which continually throw material radially away from the screw in all directions. It should also be noted with regard to single screw systems that mixing is less efficient and streaks of dry cementitious material occur generally throughout the mixture indicating a non-uniformity in combining ingredients.

Likewise, according to another aspect of the invention, the metering screw pre-feeder 90 is provided with reduced pitch segments (such as one-half or one-third pitch) in conjunction with multiple (double or triple) segments to create a labyrinth that eliminates the tendency of fluidized cementitious materials to flow around and through the feeder in an uncontrolled manner. This solves previous problems associated with attempts to use a screw pre-feeder to closely meter or regulate the feed rate of cementitious materials to a mixing or blending unit due to the fluidized nature of cementitious materials when flowing from one container such as a weigh hopper to another such as screw feeder making measurement regulation difficult.

As indicated, the most preferred arrangement of the design of the agglomerator employs intermeshing counter-rotating screws and imparts a very aggressive kneading/squeezing mixing action and strongly conveys the material through the mixing chamber and out of the outlet. As a result, it is capable of thoroughly mixing and conveying any ratio of water to dry powder materials making it possible to determine and control any selected, and preferably an optimum, water/cement ratio for each mix design and to operate the pre-mixer agglomerator at this ratio.

Figure 6:
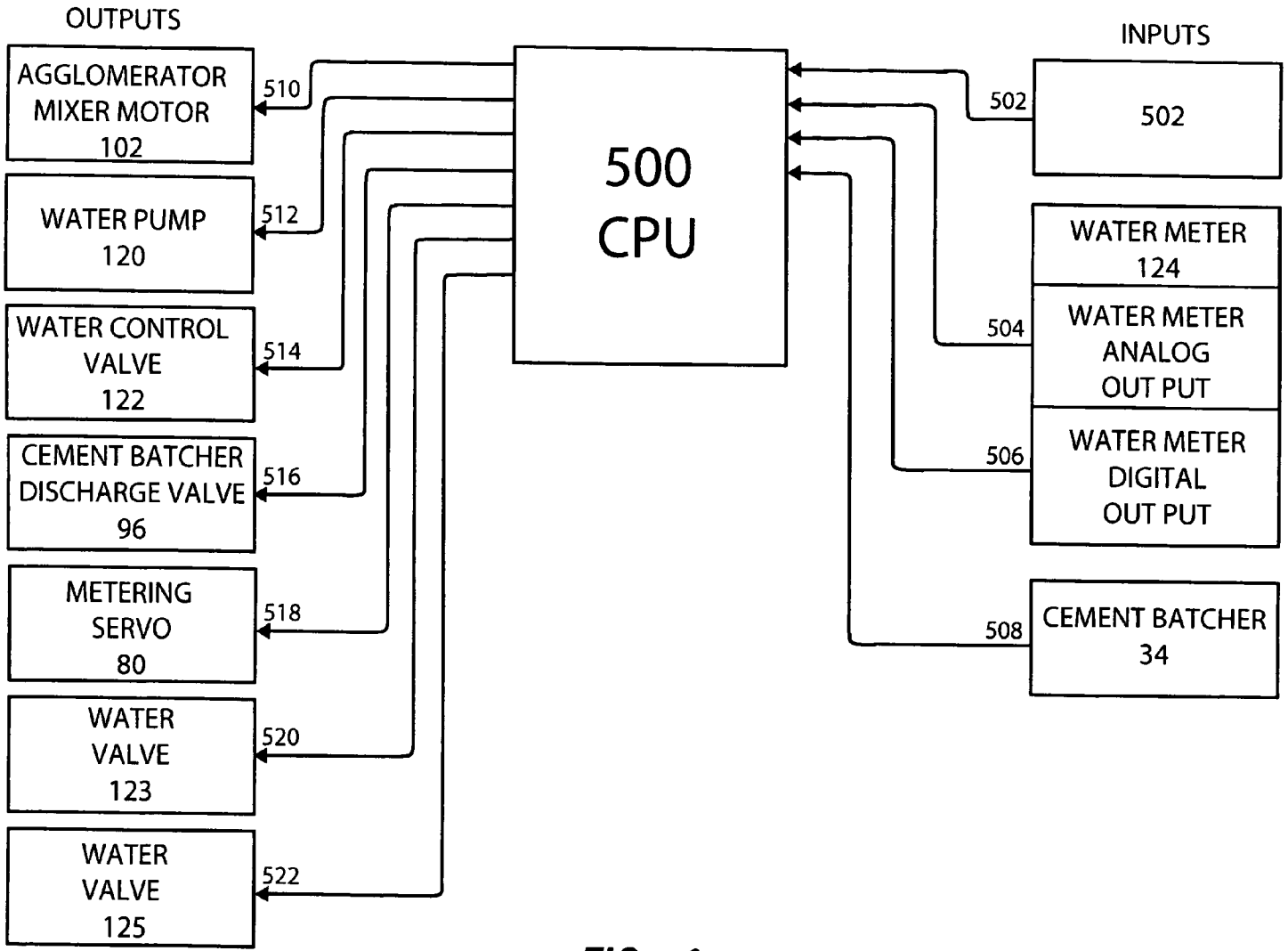
FIG. 6 is a control schematic for operating the premixing system of the invention including the ingredient supply aspect.

Components for operating the system are shown in FIG. 6. The system may be controlled by a central processing unit (CPU) microprocessor 500. The parameters of the current batch are entered and the CPU is programmed at 502. After all the ingredients for the present batch have been pre-measured the CPU will activate the agglomerator mixer motor 102 at 510. The water pump 120 will be activated at 512 and the water control valve 122 will be positioned at 514 to deliver the programmed water feed to the manifold 126. Thereafter the cement batcher valve 96 is opened at 516 and the metering screw 90 is set at 518 to the speed/feed that has been set in the CPU for that batch. The CPU will continuously monitor the feed rate of the cement by sensing weight change in weigh batcher 34 at 508 and the feed rate of the water at 504 and will adjust the position of the water feed valve 122 at 514 to maintain the water/cement ratio that has been programmed in the CPU for that batch.

After all the cementitious ingredients have been emptied from the cement batcher, metering screw and agglomerator the water feed will continue until the total amount of water called for has been delivered, as determined by the digital water input from 506, at which time the CPU will close the water valves 122, 123 and 125 at 514, 520 and 522 and turn off the water pump 120 at 512. This serves to flush the mixing and outlet sections of the agglomerator and to clean the spray nozzles. Control lines for water valves 123 and 125, which may be solenoids, are shown at 520 and 522.

In addition, if desired, the agglomerator can be by-passed with material directed from the weigh batcher through the screw-metering device into the inlet hopper of a mobile cement mixer directly through a connecting tube (not shown) by by-passing the metering device through a by-pass gate 116 through the outlet section of the agglomerator and directly into the collecting hopper 54 and into the inlet hopper 58 of a transit mixer truck. Valve 125, of course, can be used for direct injection of wetting agents.

The pre-mixer agglomerator augers or screw conveyors themselves may be constructed of any suitable materials including metals and non-metals and combinations thereof. Thus, the screw flights may be steel, steel coated with a polyamide material such as a nylon material or a polyurethane material or the like. They may be molded to the shafts using a relatively stiff composite elastomer material. It is desired that the flights resist abrasive wear and remain easily cleaned.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A concrete batching system comprising:

(1) a pre-mixing system for pre-mixing a selected portion, but less than all, of a concrete batch, said premixing system further comprising:

(a) a cementitious ingredient supply system including a weigh batcher for apportioning weighed amounts of cementitious ingredients for concrete batches excluding stone and sand aggregate materials;

(b) a pre-mixer agglomerator for blending said cementitious ingredients and wetting agents excluding said aggregate materials to form a concrete pre-mix fraction of a concrete batch, said agglomerator having spaced inlet and discharge openings toward opposite ends thereof and including a twin screw mixing and conveying system having intermeshing screw conveyors for both mixing and conveying said ingredients, said screw conveyors being further characterized by a variable pitch that increases from inlet to discharge;

(c) a pre-feeder for metering said cementitious ingredients at a selected, controlled feed rate into said pre-mixer agglomerator;

(d) a liquid supply system for supplying a selected amount of wetting agents at a selected rate for blending with said cementitious ingredients in said pre-mixer agglomerator;

(e) a control system for controlling the amounts and rates in apportioning and mixing of cementitious ingredients and wetting agents in said concrete pre-mix;

(2) an aggregate supply system configured to supply aggregate ingredients only directly to a final mixing vessel bypassing said pre-mixing system; and (3) a final mixing vessel for receiving premixed material from said pre-mixing system and aggregate from said aggregate supply system and conducting final mixing of ingredients.

2. A concrete batching system as in claim 1 wherein said control system further comprises metering devices to control the supply of wetting agents which measure both the total amount supplied and the supply rate and a shutoff valve for shutting off said supply of wetting agents when a selected total is reached.

3. A concrete batching system as in claim 2 wherein said prefeeder includes a variablespeed metering screw conveyor operable at a selected rate.

4. A concrete batching system as in claim 3 wherein said control system further comprises a central processing unit for receiving input information as to the feed rates of said cementitious ingredients and said wetting agents and generation outputs to coordinate blending thereof at selected ratios.

5. A concrete batching system as in claim 1 wherein said prefeeder includes a variable-speed metering screw conveyor operable at a selected rate.

6. A concrete batching system as in claim 1 wherein said control system further comprises a central processing unit for receiving input information as to the feed rates of said cementitious ingredients and said wetting agents and generation outputs to coordinate blending thereof at selected ratios.

7. A concrete batching system as in claim 1 wherein said liquid supply system includes a surge tank and associated pump.

8. A concrete batching system as in claim 1 wherein said liquid supply system further comprises a liquid supply source for measuring and applying said liquid wetting agents to said mixing chamber from a plurality of spaced locations in said mixing section.

9. A concrete batching system as in claim 8 wherein said twin screw mixing and conveying system has counter-rotating screws and said counter-rotation directs material away from said liquid supply system inlets.

10. A concrete batching system as in claim 1 wherein said pre-mixer agglomerator further comprises an additional inlet opening above said discharge opening to selectively allow material to pass directly through said mixing chamber unmixed.

11. A concrete batching apparatus comprising:

(1) a pre-mixing system for pre-mixing a selected portion of a concrete batch, said pre-mixing system further comprising:

(a) a cementitious ingredient supply system including a weigh batcher for apportioning weighed amounts of cementitious ingredients excluding aggregate materials for concrete batches;

(b) a pre-mixer agglomerator for blending said cementitious ingredients and said wetting agents to form a concrete pre-mix, said agglomerator being further characterized by a twin screw mixing and conveying system wherein said twin screw mixing and conveying system is characterized by intermeshing screw conveyors which both mix and convey said ingredients, said mixing and conveying system having an inlet metering section featuring a narrow pitch, a mixing section having a pitch greater than that of the inlet metering section and a discharge section having a pitch greater than that of the mixing section;

(c) a prefeeder for metering each weighed amount of cementitious ingredients at a selected, controlled feed rate into said pre-mixer agglomerator;

(d) a liquid supply system for supplying a selected amount of wetting agents at a selected rate for blending with said cementitious ingredients in said pre-mixer agglomerator;

(e) a control system for controlling the amounts and rates in apportioning and mixing of cementitious ingredients and wetting agents in said concrete pre-mix;

(2) an aggregate supply system configured to supply aggregate ingredients directly to a final mixing vessel bypassing said pre-mixing system; and (3) a final mixing vessel for receiving premixed material from said pre-mixing system and aggregate from said aggregate supply system and conducting final mixing of ingredients.

12. An apparatus as in claim 11 wherein said inlet metering section of said intermeshing mixing screw conveyors are characterized by a pitch equal to about one-half pitch or less.

13. An apparatus as in claim 12 wherein said inlet metering section of said intermeshing mixing screw conveyors are characterized by a pitch equal to about one-quarter pitch.

14. An apparatus as in claim 11 wherein said mixing section of said intermeshing mixing screw conveyors are characterized by a pitch equal to about one full pitch or less.

15. An apparatus as in claim 14 wherein said mixing section of said intermeshing mixing screw conveyors are characterized by a pitch from about one-half to about two-thirds pitch.

16. An apparatus as in claim 11 wherein said discharge section of said intermeshing mixing screw conveyors are characterized by scoops or paddles.

* * * * *